US009525941B2

(12) United States Patent
Kwon et al.

(10) Patent No.: US 9,525,941 B2
(45) Date of Patent: Dec. 20, 2016

(54) EARJACK AND ELECTRONIC DEVICE INCLUDING THE SAME

(71) Applicant: Samsung Electronics Co., Ltd., Gyeonggi-do (KR)

(72) Inventors: Taeyoun Kwon, Gyeonggi-do (KR); Myunggeun Koh, Gyeonggi-do (KR); Junho Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 98 days.

(21) Appl. No.: 14/519,875

(22) Filed: Oct. 21, 2014

(65) Prior Publication Data

US 2015/0110331 A1 Apr. 23, 2015

(30) Foreign Application Priority Data

Oct. 21, 2013 (KR) ..... 10-2013-0125134

(51) Int. Cl.
*H04R 21/02* (2006.01)
*H04R 3/02* (2006.01)
*H04R 1/10* (2006.01)

(52) U.S. Cl.
CPC ..... *H04R 3/02* (2013.01); *H04R 1/1091* (2013.01)

(58) Field of Classification Search
USPC ..... 381/384, 369
See application file for complete search history.

(56) References Cited

U.S. PATENT DOCUMENTS

| | | | | |
|---|---|---|---|---|
| 8,243,945 | B2 | 8/2012 | Li | |
| 2011/0091063 | A1* | 4/2011 | Lee | 381/384 |
| 2012/0177243 | A1 | 7/2012 | Lee et al. | |
| 2014/0307910 | A1* | 10/2014 | Howlett | H03G 3/348 381/369 |

FOREIGN PATENT DOCUMENTS

| | | |
|---|---|---|
| KR | 10-2006-0113036 | 11/2006 |
| KR | 10-2007-0022442 | 2/2007 |
| KR | 10-2007-0091926 | 9/2007 |
| KR | 10-2008-0080854 | 9/2008 |
| KR | 10-2012-0122017 | 11/2012 |

* cited by examiner

*Primary Examiner* — Amir Etesam
(74) *Attorney, Agent, or Firm* — The Farrell Law Firm, P.C.

(57) ABSTRACT

An ear jack for preventing the generation of popup noise, and an electronic device including the same are provided. The ear jack includes a body including a passage into which an earphone is inserted. On an inside of the passage is disposed a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone. The ground terminal includes a first ground terminal, according to a standard of the ear jack; and a second ground terminal for discharging an electric power of the capacitor, which is charged by the microphone bias power when the earphone is removed.

11 Claims, 7 Drawing Sheets

EARJACK AND ELECTRONIC DEVICE INCLUDING THE SAME

PRIORITY

This application claims priority under 35 U.S.C. §119(a) to Korean Patent Application No. 10-2013-0125134, filed on Oct. 21, 2013, in the Korean Intellectual Property Office, the entire content of which is incorporated herein by reference.

BACKGROUND OF THE INVENTION

1. Field of the invention

The present invention relates generally to an ear jack capable of preventing the generation of popup noise, and an electronic device including the same.

2. Description of the Prior Art

With the development of information communication technology and semiconductor technology, the spread and use of electronic devices are rapidly increasing. The recent electronic devices are not limited to their traditional unique areas, but are combined with various terminals. For example, a mobile communication terminal provides various functions such as a TV watching function (for example, mobile broadcasting such as Digital Multimedia Broadcasting (DMB) or Digital Video Broadcasting (DVB)), a music reproduction function (for example, MPEG Audio Layer-3 (MP3)), a picture photographing function, an Internet connection function, and a radio reception function, in addition to generation communication functions such as voice communication and transmission/reception of messages.

Further, the electronic device provides an earphone function for allowing a user to listen to audio and voice communications such that audio output is not exposed to the outside. Accordingly, the user may listen to music, broadcasts, recordings of voices, or voice communications using the earphone. Recent electronic devices may include an ear jack including a microphone terminal to provide a voice communication function or a voice recording function.

Generally, a standard ear jack may include a microphone terminal, a ground terminal, a right sound terminal, a left sound terminal, and a detection terminal. The standard ear jack may employ either a three-pole earphone or a four-pole earphone.

If the electronic device detects insertion of a three-pole earphone or a four-pole earphone through a detection terminal of the ear jack, it can recognize the type of an earphone connected through an output voltage of a microphone terminal. When it is recognized that a four-pole earphone including a microphone is connected to the electronic device, the electronic device may supply microphone bias power to the microphone terminal of the ear jack and may stop the supply of the microphone bias power when removal of the four-pole ear phone is detected. However, the microphone bias power is not interrupted instantaneously, but is slowly decreased over a predetermined period of time. This is because a capacitor having characteristics in which electric power is stored and slowly discharged is connected to the microphone terminal of the earjack.

In this way, a microphone terminal of the ear jack may contact the ground terminal of the four-pole earphone when the four-pole earphone is removed from the electronic device, according to the conventional art. Then, as the supply of the microphone bias power is not instantaneously interrupted, the microphone bias power is supplied to the ground terminal of the four-pole earphone, and the ground terminal of the earphone is released from the contact with the ground of the ear jack and is in an opened state. Accordingly, the microphone bias power supplied to the ground terminal of the earphone may be induced to the left sound terminal and/or the right sound terminal of the ear phone. In this case, in the electronic device, according to the conventional art, popup noise may be generated when the earphone is removed.

SUMMARY

The present invention has been made to address the above-mentioned problems and disadvantages, and to provide at least the advantages described below.

Accordingly, an aspect of the present invention is to provide an ear jack for preventing a popup noise, when an earphone is removed from an ear jack of the electronic device, and an electronic device including the same.

In accordance with an aspect of the present invention an ear jack is provided. The ear jack includes a body including a passage into which an earphone is inserted. On an inside of the passage is disposed a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone. The ground terminal includes a first ground terminal, according to a standard of the ear jack; and a second ground terminal for discharging a power of the capacitor, which is charged by the microphone bias power when the earphone is removed.

In accordance with another aspect of the present invention, an ear jack is provided. The ear jack includes a body having a passage into which an earphone is inserted, wherein on an inside of the body is disposed a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone. The ground terminal of the ear jack contacts a ground terminal of the earphone when the earphone is completely inserted, and a distance between the ground terminal of the ear jack and a microphone terminal of the ear jack is smaller than a length of the ground terminal of the earphone.

In accordance with another aspect of the present invention, an electronic device is provided. The electronic device includes an ear jack to and from which an earphone is attached and detached, respectively. The ear jack includes a body having a passage through which an earphone is inserted, wherein on an inside of the body is disposed a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone. The ground terminal of the ear jack may include a first ground terminal, according to a standard of the ear jack and a second ground terminal for discharging a power of the capacitor, which is charged by the microphone bias power when the earphone is removed.

As described above, in the ear jack and the electronic device according to various embodiments of the present invention, a popup noise (or tick noise) is not generated when the earphone, which is inserted into the ear jack, is removed.

Further, the various embodiments of the present invention do not require an addition of a separate circuit or a change of a circuit for preventing the generation of popup noise, and thus, minimize manufacturing costs of the electronic device.

BRIEF DESCRIPTION OF THE DRAWINGS

The above and other aspects, features and advantages of certain embodiments of the present invention will be more apparent from the following detailed description in conjunction with the accompanying drawings, in which.

DETAILED DESCRIPTION OF EMBODIMENTS OF THE PRESENT INVENTION

Figure 1:
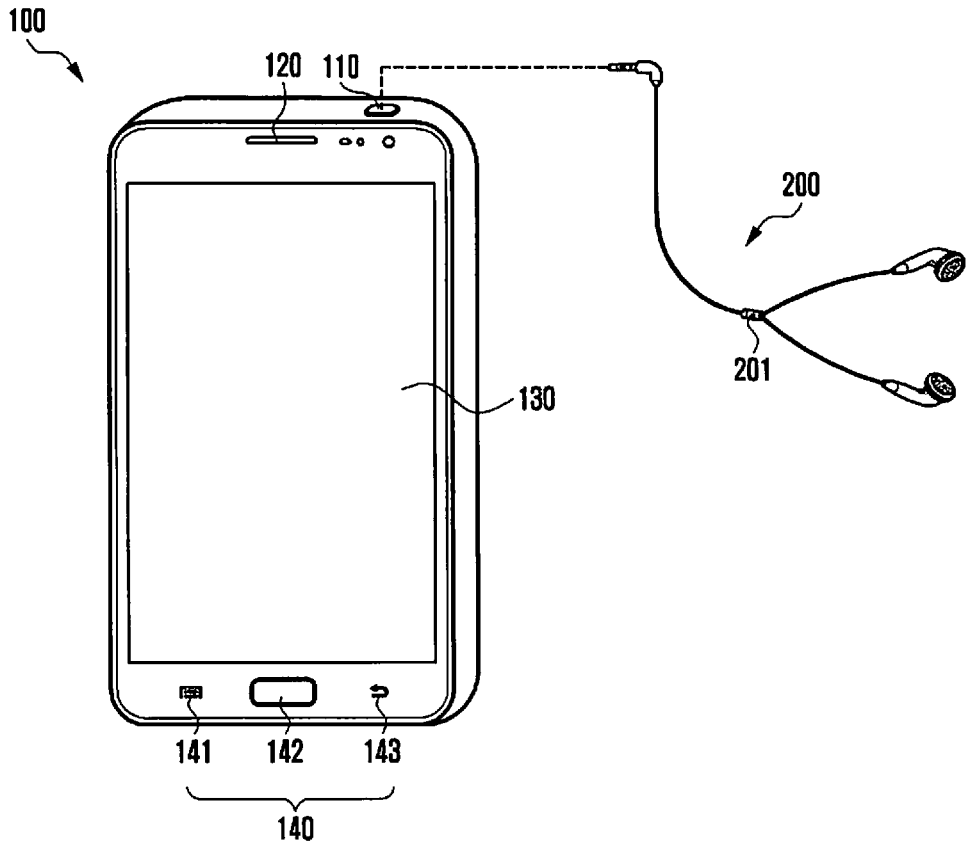
FIG. 1 is a view of an electronic device and an earphone, according to an embodiment of the present invention.

Hereinafter, various embodiments of the present invention will be described in detail with reference to the accompanying drawings. It should be noted that the same elements will be designated by the same reference numerals although they are shown in different drawings. Further, detailed descriptions related to well-known functions or configurations capable of making subject matters of the present invention unnecessarily obscure will be omitted. In the following description, it should be noted that only portions required for comprehension of operations according to the embodiments of the present invention will be described and descriptions of other portions will be omitted not to make subject matters of the present invention obscure. Also, in the accompanying drawings, some elements are exaggerated, omitted, or schematically illustrated, and the size of each element does not entirely reflect an actual size.

The various exemplary embodiments of the present invention disclosed in the present specification and the drawings have been presented to easily explain concepts of the present invention and help comprehension of the present invention, and do not limit the scope of the present invention. Therefore, it should be construed that all modifications or modified forms drawn by the technical idea of the present invention in addition to the embodiments disclosed herein are included in the scope of the present invention.

An electronic device according to the embodiment of the present invention may include a mobile communication device, a Personal Digital Assistant (PDA), a smartphone, a tablet Personal Computer (PC), a Portable Multimedia Player (PMP), and the like.

FIG. 1 is a view of an electronic device and an earphone according to an embodiment of the present invention.

Referring to FIG. 1, an electronic device 100, according to an embodiment of the present invention includes an ear jack 110 for connection of an earphone 200, a speaker 120 for outputting an audio signal, a display unit 130 for outputting image data, and an input unit 140. The earphone 200 is a four-pole earphone including a microphone 201. The input unit 140 include a menu key 141, a home key 142, and a cancel key 143.

When the earphone 200 is inserted into the ear jack 110, the electronic device 100 detects connection of the earphone 200 through a detection terminal, and recognizes the type of the earphone (a four-pole earphone or a three-pole earphone) connected to an output voltage of the microphone terminal.

The electronic device 100 includes an earphone recognition circuit for identifying an output voltage of the microphone terminal when insertion of the earphone is recognized through the detection terminal of the ear jack 110, for determining that a four-pole earphone 200 is inserted when the output voltage is a preset reference voltage or higher, and for determining that a three-pole earphone is inserted when the output voltage is the reference voltage or lower. The earphone recognition circuit includes a comparator for comparing an output voltage of the microphone terminal with the reference voltage and outputting an interrupt signal when the output voltage of the microphone terminal is larger than the reference voltage or an Analog Digital Converter (ADC) for recognizing an output voltage of the microphone terminal.

If the type of the earphone is recognized, the electronic device 100 executes a function corresponding to the type of the recognized earphone. For example, when the three-pole earphone is connected to the electronic device 100, the electronic device 100 controls an audio signal output path such that an audio signal is output to the three-pole earphone, not output to the speaker 120 and controls an audio signal reception path such that an audio signal is received using a microphone of the electronic device 100.

When the four-pole earphone 200 is connected to the ear jack 110, the electronic device 100 controls an output path of an audio signal such that an audio signal is output to the four-pole earphone 200, not output to the speaker 120. The electronic device 100 deactivates the microphone of the electronic device 100, and controls a reception path of an audio signal such that an audio signal is received through the microphone 201 of the four-pole earphone 200. To this end, when it is recognized that the four-pole earphone 200 is connected to the electronic device 100, the electronic device 100 switches on a microphone bias power source.

The ear jack 110 of the electronic device 100 includes a microphone terminal to which a capacitor is connected and to which the microphone bias power source is connected, a ground terminal, a right sound terminal for outputting a right sound signal, a left sound terminal for outputting a left sound signal, and a detection terminal for detecting insertion of the earphone. The microphone terminal, the ground terminal, the right sound terminal, the left sound terminal, and the detection terminal are disposed in a body of the ear jack 110 having a passage through which the earphone is inserted. For example, the microphone terminal, the ground terminal, the right sound terminal, the left sound terminal, and the detection terminal may be sequentially disposed while being spaced inwards apart from an inlet of the body. The detection terminal may be disposed at a location similar to that of the left sound terminal to be electrically separated from the left sound terminal.

The ground terminal of the ear jack 110 includes a first ground terminal according to a standard of the ear jack, and a second ground terminal for discharging the microphone bias power source while the earphone is removed. For example, the second ground terminal may be located outside the first ground terminal, and contacts the ground terminal of the earphone when the four-pole earphone 200 is completely inserted. The second ground terminal of the ear jack 110 may be disposed such that a distance between the microphone terminal of the ear jack and the second ground terminal of the ear jack is smaller than a length of the ground terminal of the four-pole earphone 200. Accordingly, when the four-pole earphone 200 is removed, the microphone terminal and the second ground terminal of the ear jack contacts the ground terminal of the earphone at the same time. In this case, an electric power which is charged in the capacitor by the microphone bias power source is discharged through the microphone terminal of the ear jack, the ground terminal of the earphone, and the second ground terminal of the ear jack. According to an embodiment of the present invention, as a discharge path of the microphone bias power source is formed, popup noise due to inducement of the microphone bias power when the earphone is removed is not generated.

Figure 2B:
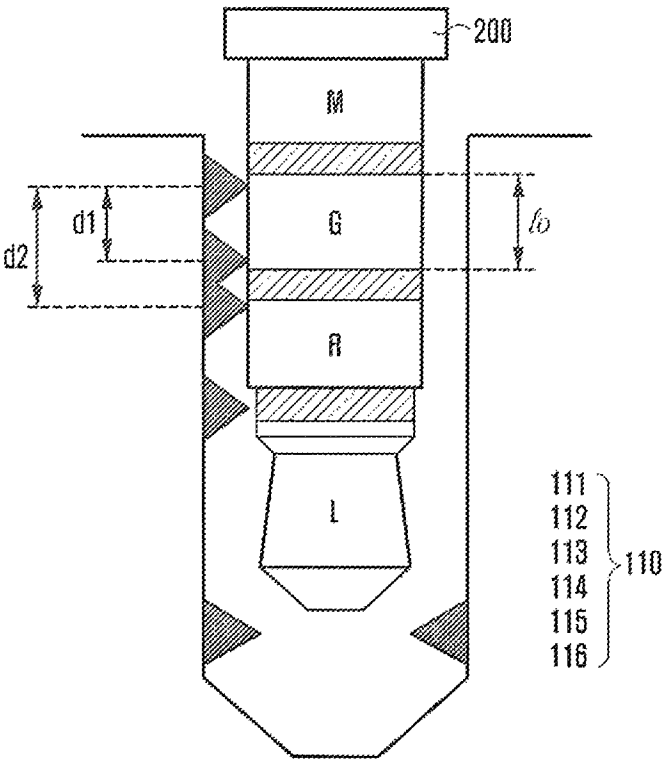
FIGS. 2A and 2B is a schematic diagram of states in which an earphone is inserted into and removed from an ear jack, according to an embodiment of the present invention.
Figure 2A:
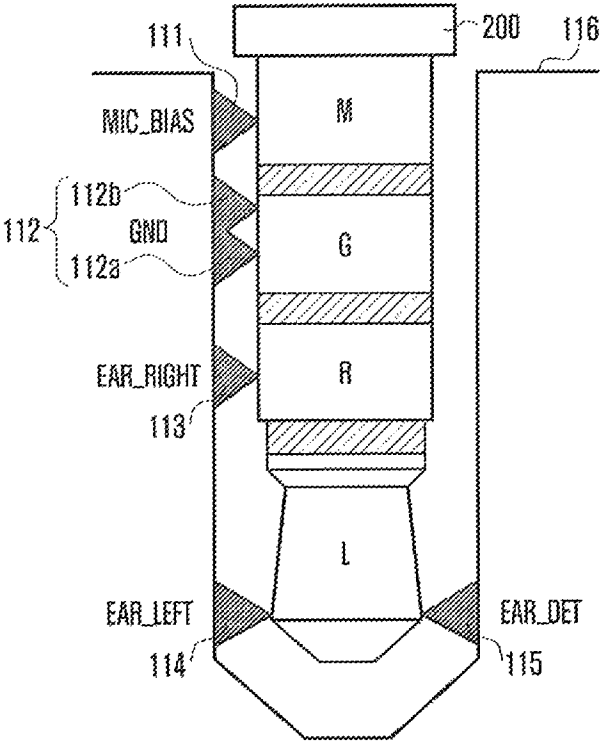

FIGS. 2A and 2B is a schematic diagram of states in which an earphone is inserted into and removed from an ear jack, according to an embodiment of the present invention.

Referring to FIG. 2A, the ear jack 110, according to an embodiment of the present invention, includes a body 116 having a passage into which the four-pole earphone 200 is inserted. A microphone terminal 111, a ground terminal 112, a right sound terminal 113, a left sound terminal 114, and a detection terminal 115 are disposed on the walls inside the body 116. The ground terminal 112 includes a first ground terminal 112*a* and a second ground terminal 112*b*. Although not shown, the ear jack 110 may include at least one fixing terminal for fixing (for example, soldering) a printed circuit board to an outside of the body 116.

The microphone terminal 111, the first ground terminal 112*a*, the second ground terminal 112*b*, the right sound terminal 113, the left sound terminal 114, and the detection terminal 115 are mounted to the body 116 to contact corresponding terminals of the four-pole earphone 200. For example, as shown in FIG. 2A, when the four-pole earphone 200 is completely inserted into the ear jack 110, the microphone terminal 111 of the ear jack 110 contacts the microphone terminal M of the four-pole earphone 200, the first ground terminal 112*a* and the second ground terminal 112*b* of the ear jack 110 contact the ground terminal G of the four-pole earphone 200, the right sound terminal 113 of the ear jack 110 contacts the right sound terminal R of the four-pole earphone 200, and the left sound terminal 114 and the detection terminal 115 of the ear jack 110 contact the left sound terminal L of the four-pole earphone 200.

The microphone terminal 111, the first ground terminal 112*a*, the second ground terminal 112*b*, the right sound terminal 113, the left sound terminal 114, and the detection terminal 115 are formed to be resilient for stable contact with the four-pole earphone 200, and are disposed to protrude through the passage of the body 116 by a predetermined distance.

The ground terminal 112 of the ear jack 110, according to an embodiment of the present invention, includes a first ground terminal 112*a* and a second ground terminal 112*b*. The first ground terminal 112*a* extends from the second ground terminal 112*b*.

A distance d1 between the microphone terminal 111 and the second ground terminal 112*b* is smaller than a length L0 of the ground terminal G of the four-pole earphone 200, and when the four-pole earphone 200 is completely inserted, the second ground terminal 112*b* is separated (by a minimum separation distance) from the microphone terminal M of the four-pole earphone 200 so as not to contact the microphone terminal M. A distance d2 between the microphone terminal 111 and the first ground terminal 112*a* follows the rule of the standard ear jack. For example, the length L0 of the ground terminal G of the four-pole earphone 200 is about 2.5 mm, and when the minimum separation distance between the second ground terminal 112*b* and the microphone terminal M is 1.5 mm, the distance d1 between the microphone terminal 111 and the second ground terminal 112*b* is more than 1.5 mm and less than 2.5 mm.

As shown in FIG. 2B, the ear jack 110, according to an embodiment of the present invention having the above-described structure contacts the microphone terminal 111 and the second ground terminal 112*b* of the ear jack 110 may contact the ground terminal G of the earphone 200 at the same time while the four-pole earphone 200 is removed. Accordingly, in the ear jack 110 the microphone bias source of the microphone terminal 111 is discharged through the ground terminal G of the earphone 200 and the second ground terminal 112*b* of the ear jack 110. A detailed description thereof will be made below with reference to FIG. 4.

Figure 3:
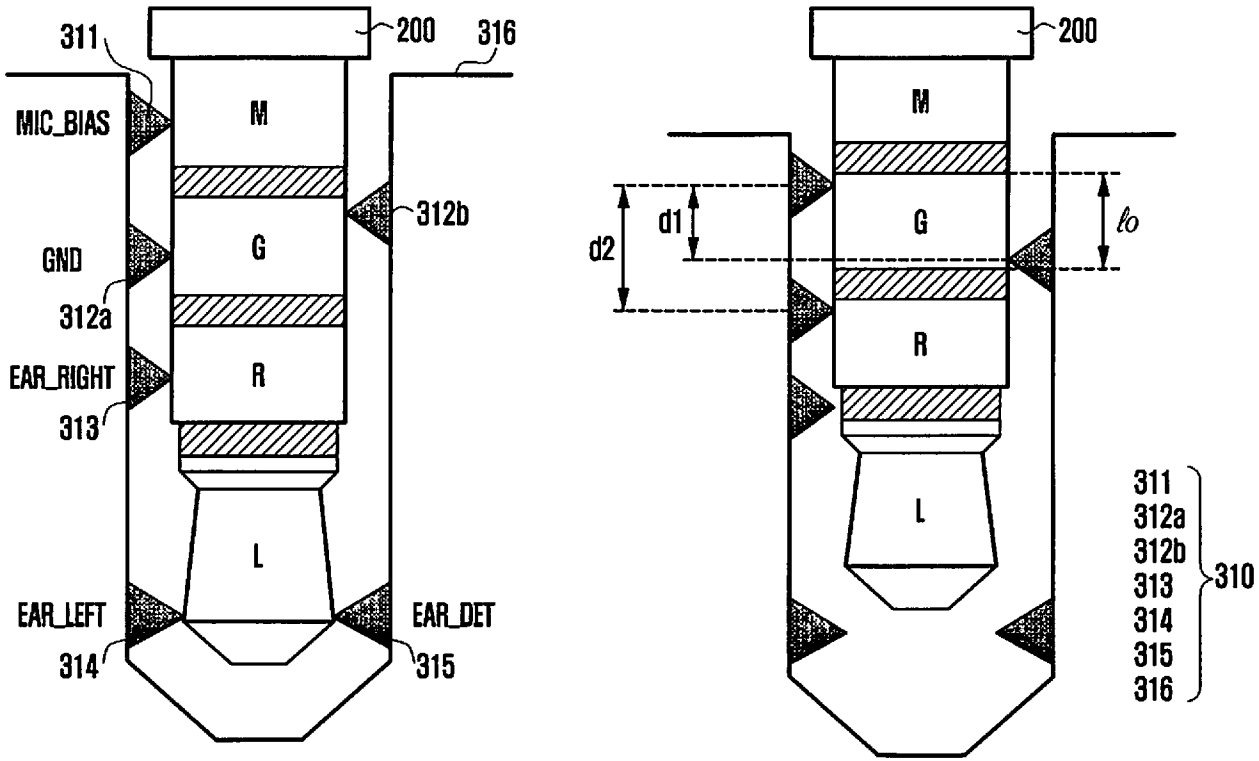
FIG. 3 is a schematic diagram of states in which an earphone is inserted into and removed from an ear jack, according to another embodiment of the present invention.

FIG. 3 is a schematic diagram of states in which an earphone is inserted into and removed from an ear jack, according to another embodiment of the present invention.

Referring to FIG. 3, the ear jack 310, according to another embodiment of the present invention, includes a body 316 having a passage through which the four-pole earphone 200 is inserted. A microphone terminal 311, a first ground terminal 312*a*, a second ground terminal 312*b*, a right sound terminal 313, a left sound terminal 314, and a detection terminal 315 are disposed on the walls inside the body 316.

The ear jack 310, according to another embodiment of the present invention, is formed such that the second ground terminal 312*b* is separated from the first ground terminal 312*a*. As also shown in the ear jack 110 of FIG. 2B, a distance d1 between the microphone terminal 311 and the second ground terminal 312*b* is smaller than a length L0 of the ground terminal G of the four-pole earphone 200. When the four-pole earphone 200 is completely inserted, the distance d1 cannot exceed a minimum separation distance through which the second ground terminal 312*b* does not contact the microphone terminal M of the four-pole earphone 200. A distance d2 between the microphone terminal 311 and the first ground terminal 312*a* follows the rule of the standard ear jack. A detailed description of other configurations will be omitted.

While it is shown in FIGS. 2 and 3 that the ear jack 110 or 310 includes the first ground terminal 112*a* or 312*a* and the second ground terminal 112*b* or 312*b*, the ear jack according to another embodiment of the present invention may not include the first ground terminal 112*a* or 312*a*, according to the ear jack standard. For example, the ear jack, according to another embodiment of the present invention, may include only one ground terminal which contacts only the ground terminal of the earphone while not contacting the microphone terminal of the earphone when the earphone is completely inserted and in which the distance from the microphone terminal of the ear jack is smaller than the length of the ground terminal of the earphone.

Figure 4:
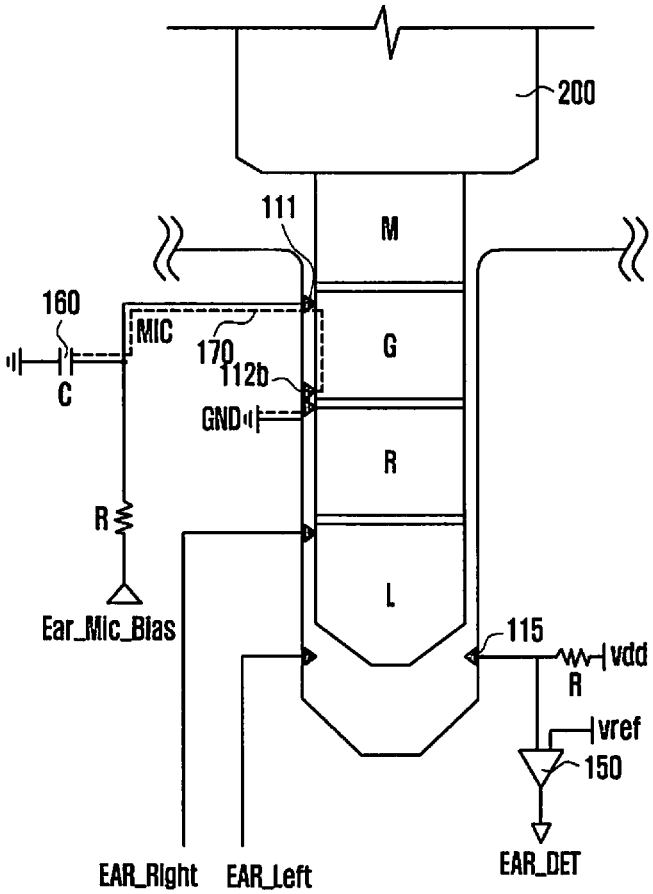
FIG. 4 is a schematic diagram of a discharging path of microphone bias power of an ear jack, according to an embodiment of the present invention.

FIG. 4 is a schematic diagram of a discharging path of microphone bias power of an ear jack, according to an embodiment of the present invention.

Figure 5:
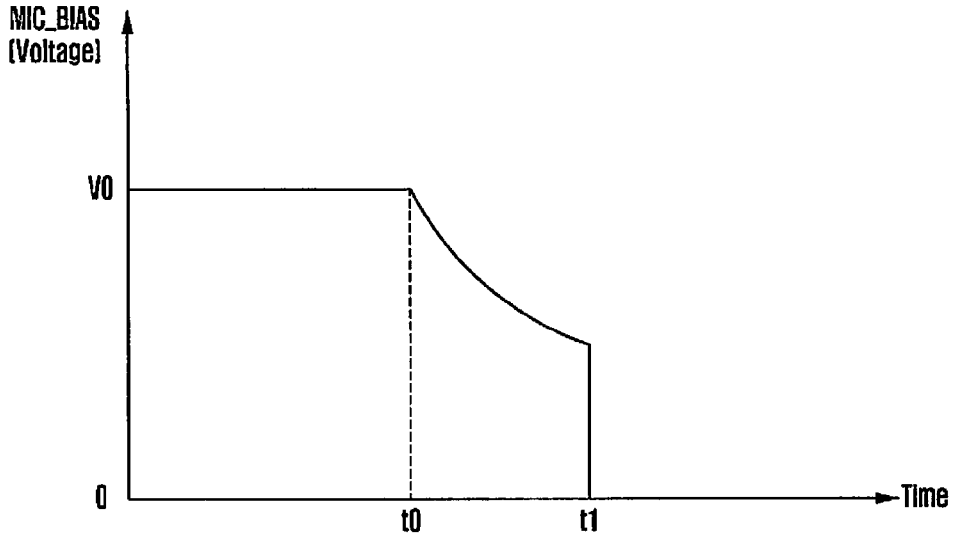
FIG. 5 is a graph depicting a change in microphone bias electric power when an earphone is removed, according to an embodiment of the present invention.

FIG. 5 is a graph depicting a change in microphone bias electric power when an earphone is removed, according to an embodiment of the present invention.

Prior to a detailed description thereof, the ear jack 110 of FIG. 2 will be described. However, it will be apparent to those skilled in the art that the following description can be applied to the ear jack 310 of FIG. 3 in the same way.

Referring to FIGS. 4 and 5, in the electronic device 100, according to an embodiment of the present invention, an output signal of the detection unit 150 is changed when the earphone 200 is completely inserted. For example, an output signal of the detection unit 150 may be changed from a low signal (for example, 0 V) to a high signal (for example, 2.5 V). Contrary, an output signal of the detection unit 150 may be changed from a high signal to a low signal. The detection unit 150 is a comparator. The comparator compares the reference voltage V_ref with a voltage of the input terminal and outputs a high signal when the voltage of the input terminal is the reference voltage V_ref or higher. A pull up voltage vdd is distributed by a ratio of a resistance R to a resistance of the left sound terminal L and is input to the input terminal of the comparator.

The electronic device 100 detects a change in the output signal of the detection unit 150 and recognizes an insertion of the earphone 200. When the insertion of the earphone 200 is recognized, the electronic device 100 supplies microphone bias power Ear_Mic_Bias to the microphone terminal 111. Then, electric power is stored (for example, charged) in the capacitor 160 connected to the microphone terminal 111.

The microphone terminal 111 of the ear jack 110 maintains the microphone bias voltage V0 before the disconnection of the earphone 200 is recognized. For example, as shown in FIG. 5, during the time period from 0 to t0, the microphone terminal 111 maintains a voltage of V0.

When the earphone 200 is removed from the ear jack 110, the contact of the detection terminal 115 with the left sound terminal L of the earphone 200 is released. In this case, the output signal of the detection unit 150 is changed. For example, the output signal of the detection unit 150 may be changed from a high signal to a low signal or from a low signal to a high signal. The electronic device 100 detects a change in the output signal of the detection unit 150 and recognizes a removal of the earphone 200.

When the disconnection of the earphone 200 is recognized, the electronic device 100 stops supply of the microphone bias power, for example, at a time point of t0. Then, the capacitor 160 starts to slowly discharge the stored electric power. For example, as shown in FIG. 5, in a time period from t0 to t1, a voltage of the microphone terminal 111 is slowly decreased.

The microphone terminal 111 and the second ground terminal 112*b* of the ear jack 110 may contact the ground terminal G of the earphone 200 at the same time, for example, at a time point of t1. In this case, the microphone bias power Ear_Mic_Bias is discharged to the ground GND of the electronic device 100 through the microphone terminal 111, and the ground terminal G and the second ground terminal 112*b* of the earphone 200. For example, the microphone bias power stored in the capacitor 160 is discharged through a discharge path 170 indicated by a dotted line of FIG. 4. In this case, as shown in FIG. 5, the output voltage of the microphone terminal 111 is decreased to a ground voltage (for example, 0 V) at a time point of t1.

In this way, in the ear jack 110, according to an embodiment of the present invention, a discharge path is formed while the earphone 200 is removed, and popup noise is not generated as the microphone bias power is discharged through the discharge path.

Figure 6:
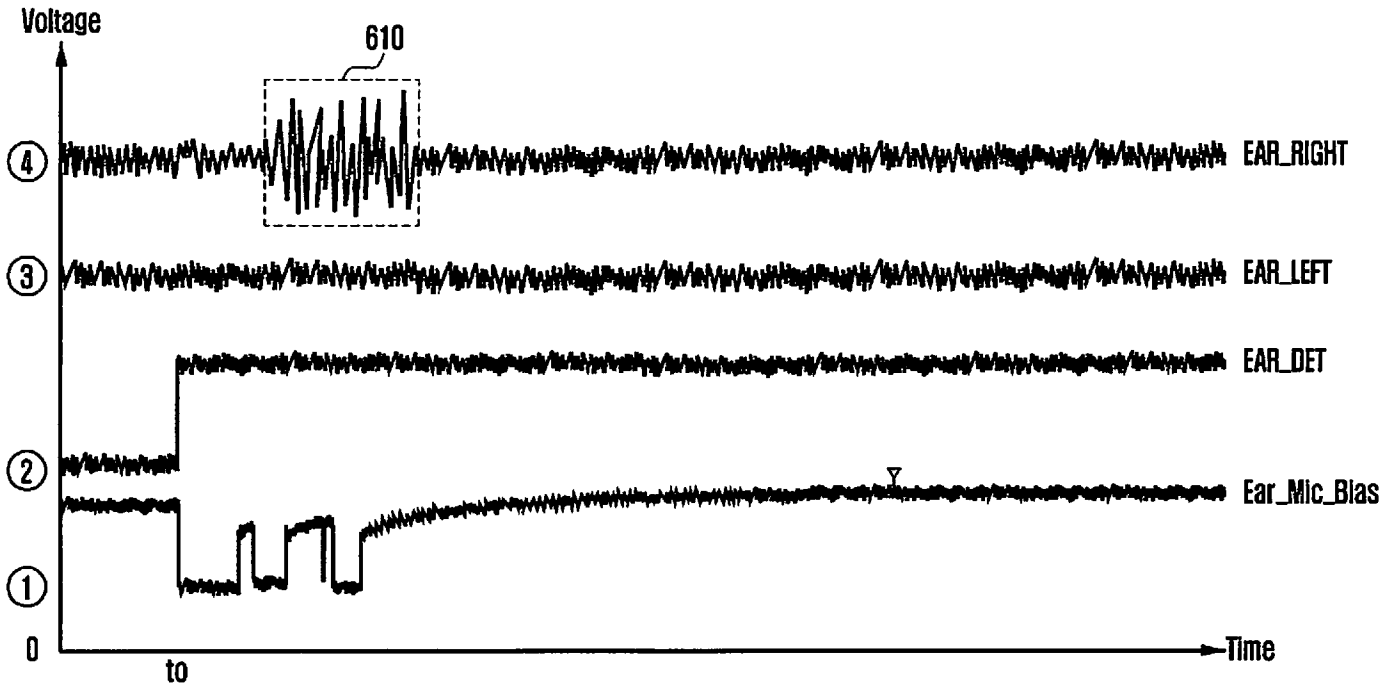
FIG. 6 (PRIOR ART)
FIG. 6 is a graph depicting the measurement of voltage changes of terminals when an earphone is removed from an ear jack, according to the prior art.

FIG. 6 is a graph depicting the measurement of voltage changes of terminals when an earphone is removed from an ear jack, according to the prior art.

Figure 7:
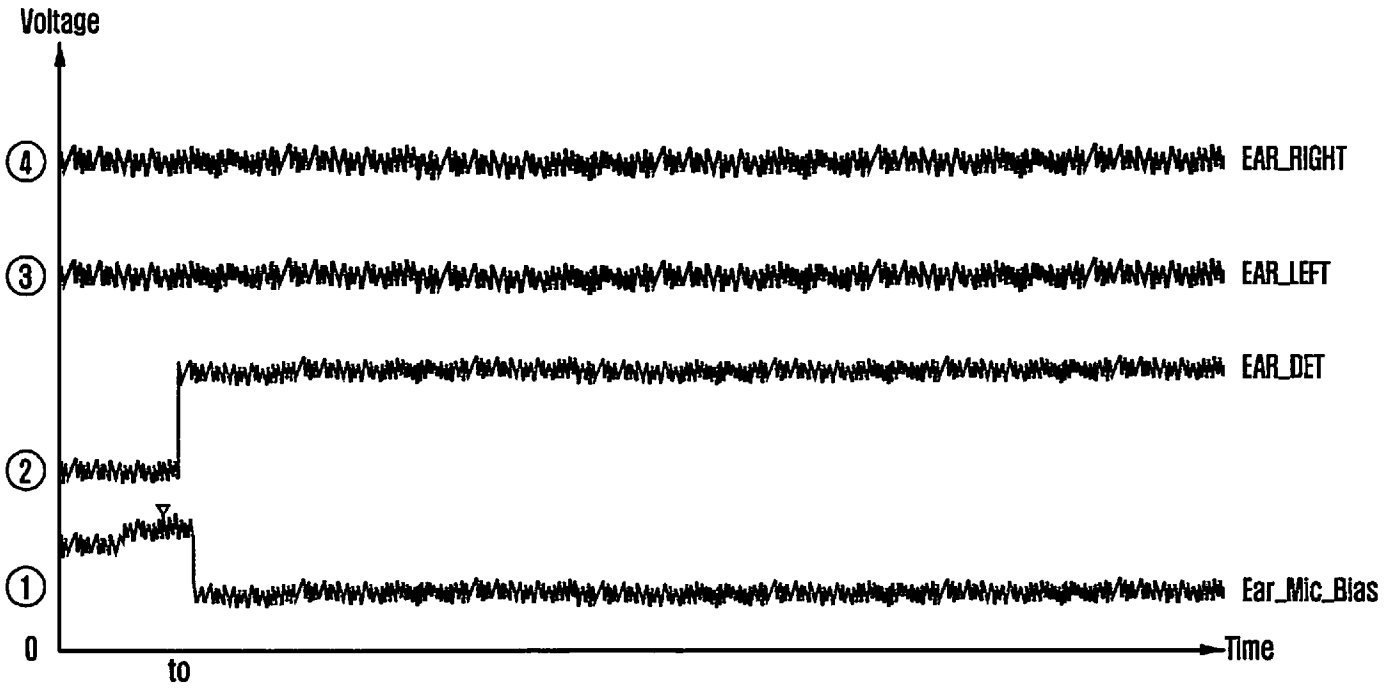
FIG. 7 is a graph depicting the measurement of voltage changes of terminals when an earphone is removed from an ear jack, according to an embodiment of the present invention.

FIG. 7 is a graph depicting the measurement of voltage changes of terminals when an earphone is removed from an ear jack, according to an embodiment of the present invention.

Referring to FIGS. 6 and 7, it can be seen that in the standard ear jack, according to the prior art, popup noise 610 is generated in the right sound terminal after the disconnection of the earphone 200 is recognized. Then, it can be seen that the microphone bias power Ear_Mic_Bias is shaken, and accordingly popup noise is generated.

It can be seen that in the ear jack 110, according to the embodiment of the present invention, popup noise is not generated in the right sound terminal 113 after the disconnection of the earphone 200 is recognized. Further, it can be seen that the microphone bias power Ear_Mic_Bias is decreased to the ground voltage after the disconnection of the earphone 200 is recognized. This is because the microphone bias power Ear_Mic_Bias is discharged through a discharge path.

Although the case including an ear jack and the electronic device including the same, according to various embodiments of the present invention, have been described through the present specification and accompanying drawings by using the specific terms, the terms are merely used as general meanings to easily describe various embodiments of the present invention and assist an understanding of the present invention, and the present invention is not limited to the above-described embodiments. That is, it will be obvious to those skilled in the art to which the present invention belongs that various embodiments can be implemented based on the technical idea of the present invention.

What is claimed is:

1. An ear jack comprising:

a body including a passage into which an earphone is inserted;

a microphone terminal to which a capacitor is connected, the microphone terminal for receiving microphone bias power when the earphone is connected to the ear jack;

a ground terminal;

a right sound terminal for outputting right sounds;

a left sound terminal for outputting left sounds; and a detection terminal for detecting insertion of the earphone, wherein the ground terminal comprises:

a first ground terminal, according to a standard of the ear jack, and a second ground terminal for discharging an electric power of the capacitor, which is charged by the microphone bias power, and wherein, while the earphone is removed, a ground terminal of the earphone is connected with both the microphone terminal and the second ground terminal, and the electric power of the capacitor is discharged to the second ground terminal through the ground terminal of the earphone and the microphone terminal.

2. The ear jack of claim 1, wherein the second ground terminal is electrically connected with the first ground terminal.

3. The ear jack of claim 1, wherein the second ground terminal is formed separately from the first ground terminal.

4. The ear jack of claim 1, wherein a distance between the microphone terminal and the second ground terminal is smaller than a length of the ground terminal of the earphone, and the second ground terminal contacts the ground terminal of the earphone when the earphone is completely inserted.

5. An ear jack comprising:

a body including a passage into which an earphone is inserted, wherein on an inside of the passage is disposed:

a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone, wherein the ground terminal of the ear jack contacts a ground terminal of the earphone when the earphone is completely inserted, a distance between the ground terminal of the ear jack and a microphone terminal of the ear jack is smaller than a length of the ground terminal of the earphone, and the length of the ground terminal of the earphone is longer than lengths of the microphone terminal, the right sound terminal, and the left sound terminal.

6. An electronic device comprising an ear jack to and from which an earphone is attached and detached, respectively, wherein the ear jack comprises:

a body including a passage into which an earphone is inserted, wherein on an inside of the passage is disposed a microphone terminal to which a capacitor is connected, the microphone terminal for receiving microphone bias power when the earphone is connected to the ear jack, a ground terminal, a right sound terminal for outputting right sounds, a left sound terminal for outputting left sounds, and a detection terminal for detecting insertion of the earphone, wherein the ground terminal of the ear jack comprises:

a first ground terminal, according to a standard of the ear jack; and a second ground terminal for discharging an electric power of the capacitor, which is charged by the microphone bias power, wherein, while the earphone is removed, a ground terminal of the earphone is connected with both the microphone terminal and the second ground terminal, and the electric power of the capacitor is discharged to the second ground terminal through the ground terminal of the earphone and the microphone terminal.

7. The electronic device of claim 6, wherein a distance between the microphone terminal and the second ground terminal is smaller than a length of the ground terminal of the earphone, and the second ground terminal contacts the ground terminal of the earphone when the earphone is completely inserted.

8. The electronic device of claim 6, wherein the microphone terminal of the ear jack and the second ground terminal of the ear jack are further formed to contact the ground terminal of the earphone at the same time the earphone is removed.

9. The electronic device of claim 6, wherein the second ground terminal is formed to extend from the first ground terminal or is formed separately from the first ground terminal.

10. The electronic device of claim 6, further comprising an earphone recognition circuit for identifying an output voltage of the microphone terminal when insertion of the earphone is detected through the detection terminal, determining that a four-pole earphone is inserted when the output voltage is a preset reference voltage or higher, and determining that a three-pole earphone is inserted when the output voltage is lower than the preset reference voltage.

11. The electronic device of claim 10, wherein when it is determined that the four-pole earphone is inserted, the microphone bias voltage is supplied to a microphone terminal of the earphone.

* * * * *